US008063585B2

(12) United States Patent
Trattler

(10) Patent No.: US 8,063,585 B2
(45) Date of Patent: Nov. 22, 2011

(54) POWER SUPPLY SYSTEM AND METHOD FOR THE OPERATION OF AN ELECTRICAL LOAD

(75) Inventor: Peter Trattler, Graz (AT)

(73) Assignee: austriamicrosystems AG, Unterpremstätten (AT)

( * ) Notice: Subject to any disclaimer, the term of this patent is extended or adjusted under 35 U.S.C. 154(b) by 423 days.

(21) Appl. No.: 11/922,832

(22) PCT Filed: Jun. 14, 2006

(86) PCT No.: PCT/EP2006/005749

§ 371 (c)(1),
(2), (4) Date: Jan. 26, 2009

(87) PCT Pub. No.: WO2006/136321

PCT Pub. Date: Dec. 28, 2006

(65) Prior Publication Data

US 2009/0212717 A1 Aug. 27, 2009

(30) Foreign Application Priority Data

Jun. 20, 2005 (DE) ..... 10 2005 028 403

(51) Int. Cl.
*H05B 37/02* (2006.01)

(52) U.S. Cl. ..... 315/307; 315/224; 315/247; 315/294

(58) Field of Classification Search ..... 315/185 R, 315/193, 209 R, 224–226, 246–247, 291, 315/294, 297, 299, 307–308, 312; 363/59, 363/60; 323/222, 282–284
See application file for complete search history.

(56) References Cited

U.S. PATENT DOCUMENTS

| | | | | |
|---|---|---|---|---|
| 4,237,405 | A | 12/1980 | Kellis | |
| 4,302,726 | A | 11/1981 | Shobbrook | |
| 6,091,614 | A * | 7/2000 | Malenfant | 363/97 |
| 6,160,354 | A | 12/2000 | Ruvinskiy et al. | |
| 6,320,330 | B1 * | 11/2001 | Haavisto et al. | 315/291 |
| 6,586,890 | B2 | 7/2003 | Min et al. | |
| 6,864,867 | B2 * | 3/2005 | Biebl | 345/82 |
| 6,949,892 | B2 * | 9/2005 | Horiuchi et al. | 315/308 |

(Continued)

FOREIGN PATENT DOCUMENTS

DE 4443469 6/1996

(Continued)

OTHER PUBLICATIONS

P. Allen et al., "CMOS Analog Circuit Design", Oxford University Press, New York, p. 475, 2002.

(Continued)

*Primary Examiner* — Douglas W Owens
*Assistant Examiner* — Tung X Le
(74) *Attorney, Agent, or Firm* — Cozen O'Connor

(57) ABSTRACT

A current source arrangement, in which at least one branch, comprising a current source (1) and means (2) for the connection of an electrical load (3), is provided. A comparator (5) with transistor (7) connected downstream is connected to a voltage tapping node (4) of said branch. The transistor (7) is connected to a common signal line (8), which is in turn connected to a feedback input of a DC voltage regulator (10). The arrangement can be extended with any number of further branches given a common signal line (8). The current source arrangement proposed is suitable in particular for supplying a plurality of LED array segments for illumination applications and displays.

19 Claims, 5 Drawing Sheets

U.S. PATENT DOCUMENTS

| | | | | |
|---|---|---|---|---|
| 7,262,582 | B2 * | 8/2007 | Warita et al. | 323/222 |
| 7,276,861 | B1 * | 10/2007 | Shteynberg et al. | 315/291 |
| 7,511,436 | B2 * | 3/2009 | Xu | 315/307 |
| 7,622,871 | B2 * | 11/2009 | Awalt et al. | 315/291 |
| 2002/0047642 | A1 * | 4/2002 | Miyagawa | 315/307 |
| 2002/0140380 | A1 * | 10/2002 | Biebl | 315/291 |
| 2004/0124889 | A1 | 7/2004 | Koharagi et al. | |
| 2004/0263094 | A1 * | 12/2004 | Lister | 315/291 |
| 2005/0088207 | A1 | 4/2005 | Rader et al. | |
| 2006/0119291 | A1 * | 6/2006 | Hung et al. | 315/291 |

FOREIGN PATENT DOCUMENTS

| | | | |
|---|---|---|---|
| DE | 198 41 270 | | 3/2000 |
| DE | 103 18 780 | | 12/2004 |
| EP | 0 542 480 | | 5/1993 |
| EP | 1 477 950 | | 2/2003 |
| EP | 1447950 | | 2/2003 |
| EP | 1 499 165 | A2 | 1/2005 |
| JP | 06-22817 | | 6/1994 |
| JP | 11-215811 | | 8/1999 |
| JP | 2000-347613 | | 12/2000 |
| JP | 2001-67132 | | 3/2001 |
| JP | 2002-008409 | A | 1/2002 |
| JP | 2003-158300 | | 5/2003 |
| JP | 2003-332624 | | 11/2003 |
| JP | 2005-011895 | | 1/2005 |
| JP | 2005-033853 | | 2/2005 |
| JP | 2005-160241 | | 6/2005 |
| JP | 2005-537669 | A | 12/2005 |
| JP | 2006-278304 | A | 10/2006 |
| WO | WO 2004/021744 | A1 | 3/2004 |

OTHER PUBLICATIONS

U. Tietze et al., "Halbleiterschaltungstechnik", 11th edition, Springer Verlag Berlin, pp. 821-823, 1999.

Notification of Reasons for Refusal (English translation enclosed) issued in the corresponding Japanese Patent Application No. 2008-517379 on Mar. 16, 2010.

Song, B-S., "A Precision Curvature-Compensated CMOS Bandgap Reference", IEEE Journal of Solid-State Circuits, vol. 18, No. 6, Dec. 1983, pp. 634-643.

* cited by examiner

POWER SUPPLY SYSTEM AND METHOD FOR THE OPERATION OF AN ELECTRICAL LOAD

RELATED APPLICATIONS

This is a U.S. national stage of application No. PCT/EP2006/005749, filed on 14 Jun. 2006.

This patent application claims the priority of German patent application no. 10 2005 028 403.5 filed Jun. 20, 2005, the disclosure content of which is hereby incorporated by reference.

FIELD OF THE INVENTION

The present invention relates to a current source arrangement, the use thereof, and a method for operating an electrical load.

BACKGROUND OF THE INVENTION

Current source arrangements serve for example to supply one or more electrical loads with electrical power. In this case, it is possible to provide for example a plurality of series circuits, comprising a respective current source and a respective assigned load. If the branches connected in parallel in this way are supplied with a common supply voltage, then it may be desirable to regulate the supply voltage. In this case, by way of example, the voltage dropped across each current sink can be measured and the minimum one of the current sink voltages can then be determined. This lowest current sink voltage is compared with a setpoint value and the supply voltage is varied in a manner dependent on the comparison result. This ensures that the minimum voltage dropped across the current sinks corresponds at least to the threshold value. As a result, all the current sources operate in a predetermined voltage range.

SUMMARY OF THE INVENTION

It is an object of the present invention to specify a current source arrangement and a method for operating an electrical load, in which a simple circuit construction is possible in conjunction with good efficiency.

This and other objects are attained in accordance with one aspect of the invention directed to a current source arrangement comprising a current source and, connected thereto, a means for the connection of an electrical load. The current source and the means for the connection of an electrical load are connected to one another in such a way that a common current path is formed in the case of a connected electrical load. A voltage tapping node is coupled to the means for the connection of an electrical load. Said node is designed in such a way that a voltage dropped across the electrical load and/or the current source or a signal derived therefrom can be tapped off at said node. A comparator is connected by its first input to the tapping node. A second input of the comparator is set up for feeding in a reference threshold. An output of the comparator is connected to a control input of a transistor. The transistor has a controlled path connected between a signal line and a reference potential terminal. A DC voltage regulator, for example a DC/DC converter, is designed at an input for feeding in an input voltage. An output of the DC voltage regulator is connected to the means for the connection of the electrical load. A feedback input of the DC voltage regulator is connected to the signal line.

If an excessively low voltage is dropped across the current source, the signal line is pulled down. Consequently, the feedback input of the DC voltage regulator is also pulled down. This has the effect that the DC voltage regulator compensates for this by increasing its output voltage in order to obtain the correct feedback voltage at the feedback input again.

It goes without saying that instead of one branch, comprising a current source and means for the connection of an electrical load, it is also possible for a plurality of such branches to be provided. In this case, each branch, comprising a means for the connection of an electrical load and an assigned current source, is preferably assigned a respective comparator with a transistor connected downstream. The signal line and the DC voltage regulator are common to all the branches, however.

Preferably, at least one further current source and at least one further means for the connection of an electrical load are provided, said means being connected to the at least one further current source. At least one further voltage tapping node is coupled to the at least one further means for the connection of an electrical load. At least one further comparator having a first input, which is connected to the at least one further tapping node, and having a second input set up for feeding in at least one further reference threshold is provided. Connected thereto is at least one further transistor connected to the common signal line on the load side.

If an excessively low voltage is then dropped across any of the current sources, it pulls the common signal line down via the comparator and the transistor. Consequently, the feedback input of the DC voltage regulator is also pulled down, which is compensated for by the DC voltage regulator by increasing the supply voltage at its output until the voltage at the feedback input again corresponds to the desired setpoint value.

The disclosed arrangement has a high efficiency and can be realized in a simple manner and in a small structural design. Furthermore, it is distinguished by the fact that it can easily be extended, cascaded and configured almost as desired. Any desired number of current sources can be added without necessitating additional electric circuits, even across different semiconductor chips. Only a single line, namely the line referred to here as signal line, is required between a plurality of current sources. If in each case a plurality of different load types are intended to be driven, for example red, green and blue (RGB) light-emitting diodes, abbreviated to LEDs, then the current sources can preferably be arranged in groups in such a way that a common signal line is provided for each load type.

The reference thresholds can be identical or different.

The electrical loads comprise respectively at least one light-emitting diode or a series circuit of a plurality of light-emitting diodes.

As an alternative, the branches, comprising respectively a current source and a means for the connection of an electrical load, can be combined in groups in such a way that a means for selecting a minimum input voltage is connected between the tapping nodes of such a group and the comparator.

If different types of electrical loads are intended to be driven, then a respective common signal line can be provided for each type of electrical loads. By way of example, the types of loads can be light-emitting diodes having different colors, for example red, green and blue light-emitting diodes.

The voltage tapping node can be coupled to the means for the connection of an electrical load in such a way that the voltage tapping node is formed at a control terminal of a current source transistor, the controlled path of the current source transistor being formed in a common current path with the means for the connection of the electrical load. This has the advantage over a voltage tapping between current source and electrical load that a more reliable signal tapping is ensured in the event of manufacturing fluctuations of the transistor parameters.

The comparator can comprise an operational amplifier. The combination of comparator and transistor connected downstream is preferably designed in such a way that, in the case of different inputs levels at the input of the comparator, the output level is not rapidly toggled to an extreme value, rather a signal proportional to the difference at the input is provided at the output. This means that a finite gain is preferably provided. Said gain can be specified in amperes per volt (current output to voltage input).

The DC voltage regulator preferably comprises a so-called DC/DC converter. The latter is preferably formed as a so-called inductive buck converter, boost converter, buck/boost converter, capacitive charge pump, LDO (linear controller) or the like.

A low-pass filter is preferably provided for stabilizing the regulating circuit of the DC/DC converter.

Minimum and maximum limits for the output voltage of the DC/DC converter can be set exactly by resistance divider ratios. What can advantageously be achieved thereby is that even when an electrical load fails, the supply voltage at the output of the DC/DC converter always remains within the predetermined limits for this output voltage.

The disclosed arrangement is suitable for illumination applications such as for the backlighting of liquid crystal displays, LCD. The disclosed arrangement can be used in those illumination applications in which a plurality of LED series circuits or chains are provided.

The invention is explained in more detail below using a plurality of exemplary embodiments with reference to the drawings.

DETAILED DESCRIPTION OF THE DRAWINGS

Figure 1:
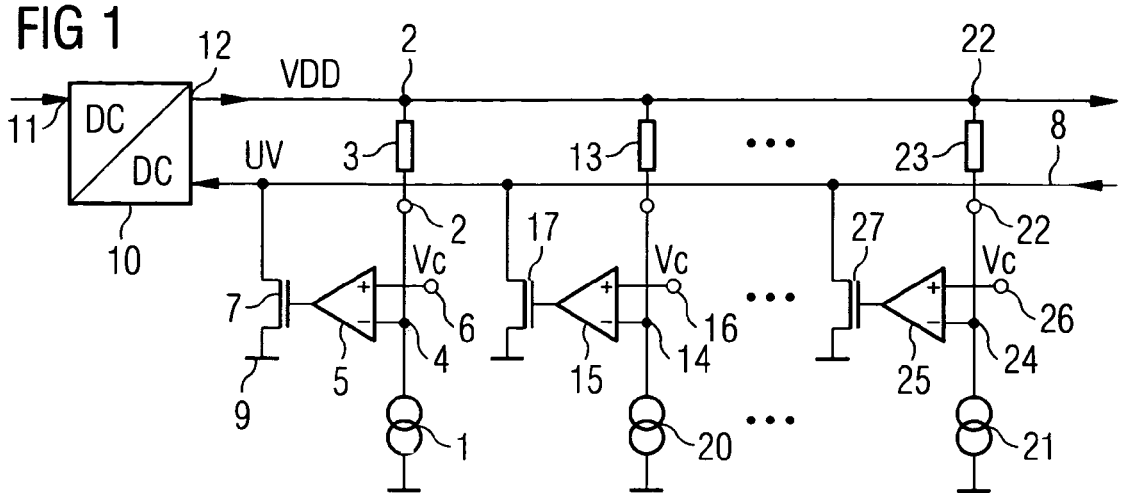
FIG. 1 shows an exemplary embodiment of a current source arrangement according to the invention on the basis of a circuit diagram.

FIG. 1 shows a current source arrangement according to an embodiment of the invention. A current source 1 is connected in a common current path to a connection means 2 for the connection of an electrical load 3. A voltage tapping node 4 is formed between the current source 1 and the electrical load 3. The voltage tapping node 4 is connected to an inverting input of a comparator 5. A further input of the comparator 5 is provided with reference symbol 6, formed in non-inverting fashion and designed for feeding in a reference threshold Vc. The output of the comparator 5 is connected to the control input of an assigned transistor 7. Transistor 7 can be a MOSFET or bipolar transistor. The controlled path of the transistor 7 is connected between a common signal line 8 and a reference potential terminal 9. The signal line 8 is connected to a feedback input of a DC voltage regulator 10 for the driving thereof. The DC voltage regulator 10 has an input 11 for feeding in an input voltage and an output 12 for providing a supply voltage VDD in a manner dependent on the input voltage and the level of the common signal line 8. Said output 12 of the DC voltage regulator 10 is connected to a further terminal of the connection means 2 for the connection of the electrical load 3.

Analogously to the current branch comprising the electrical load 3 and the current source 1, further current branches comprising respectively a further electrical load 13, 23 and a further current source 20, 21 are provided. Here in each case one terminal of the electrical loads 3, 13, 23 is connected to the output 12 of the DC voltage regulator. A comparator 5, 15, 25 with transistor 7, 17, 27 connected downstream is connected to each of said branches, comprising an electrical load 3, 13, 23 and a current source 1, 20, 21, via the respective voltage tapping node 4, 14, 24. Each of said transistors 7, 17, 27 is connected by a load terminal to the common signal line 8, which carries a feedback voltage UV.

The signal UV of the common signal line controls the supply voltage VDD. If one of the current sources 1, 20, 21 has an excessively low voltage (a voltage below the comparison potential Vc), the line 8 is pulled down somewhat with respect to the voltage UV. Consequently, the voltage at the feedback input of the DC voltage regulator 10 is also pulled down. This is compensated for by the DC voltage regulator 10 by increasing the voltage VDD at the output 12. The voltage VDD at the output is increased until the correct voltage UV is present at the feedback input. With the correct voltage, the current sources 1, 20, 21 each have a voltage which is not below the reference potential Vc.

The DC voltage regulator 10 can be any adjustable DC/DC converter. This serves for driving the loads 3, 13, 23 with high efficiency. By way of example, the voltage regulator 10 can be an inductive buck, boost, buck/boost regulator or a capacitive charge pump or a simple series regulator.

The circuit in accordance with FIG. 1 has a simple circuit construction which can be realized in particular using integrated circuit technology with a small area requirement. The circuit can easily be extended, cascaded and configured with additional branches. Any desired number of current sources can be added, for which no additional electric circuits are required. An advantageous special feature of the circuit according to FIG. 1 is that only one line, namely the common signal line 8, is necessary for coupling the individual current source branches to one another.

Figure 2:
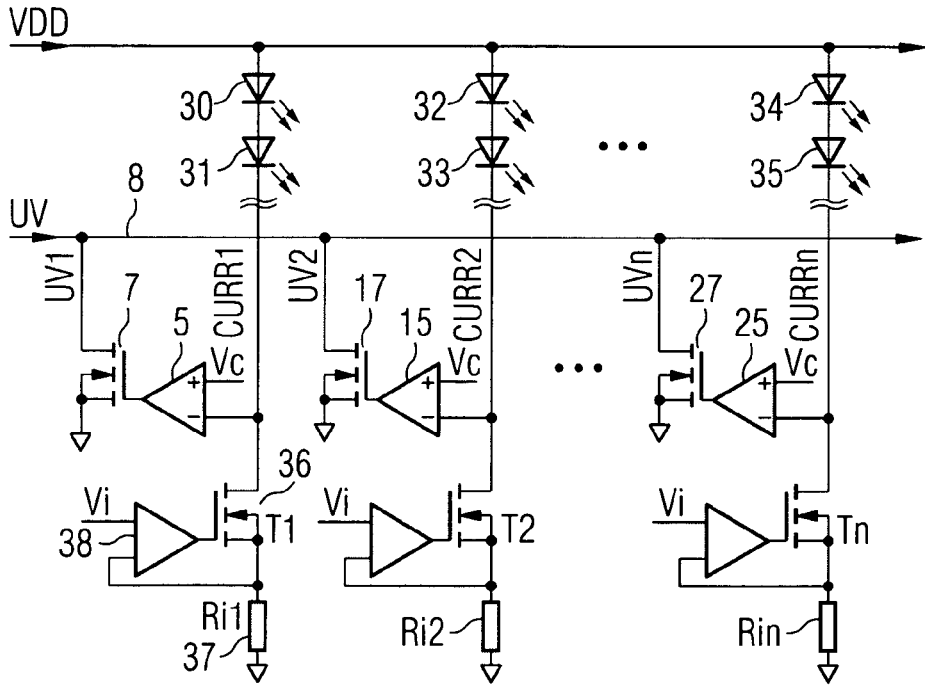
FIG. 2 shows a further exemplary embodiment of a current source arrangement according to the invention on the basis of a circuit diagram.

FIG. 2 shows a further exemplary embodiment of a current source arrangement according to the invention, which largely corresponds to the circuit in accordance with FIG. 1 in terms of the components used and their advantageous interconnection with one another. In this respect, the description of the circuit is not repeated at this juncture. In the case of FIG. 2, the electrical loads 3, 13, 23 are embodied respectively as a series circuit of a plurality of light-emitting diodes, LEDs 30, 31;

32, 33; 34, 35. In the case of FIG. 2, the current sources 1, 20, 21 are embodied with a respective current source transistor 36, the controlled path of which is connected between the respective tapping node 4, 14, 24 and a respective resistor 37 connected with respect to reference potential. The control input of the current source transistor 36 is connected to the output of a differential amplifier 38 having two inputs. One input is formed as a terminal for feeding in a reference threshold Vi, while the other input is connected to that load terminal of the transistor 36 which is connected with respect to the resistor 37. In the case of FIG. 2, the DC voltage regulator 10 is not depicted for the sake of clarity.

Compared with a conventional current source, the current source 36, 37, 38 in accordance with FIG. 2 is particularly advantageous with regard to stability and adjustability.

Figure 3:
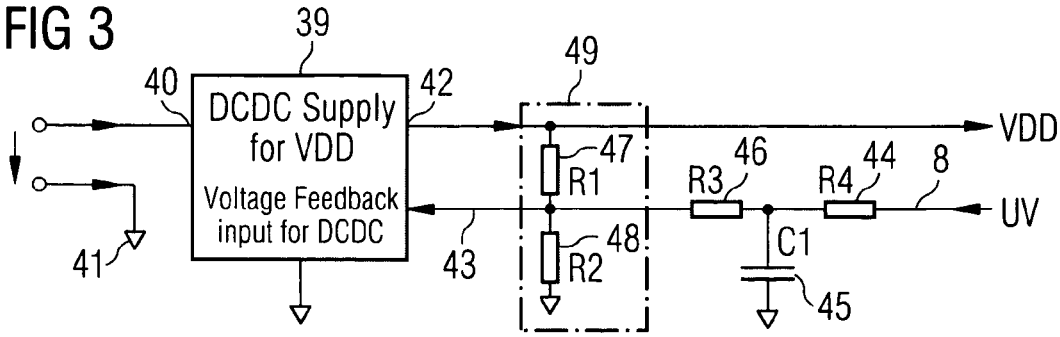
FIG. 3 shows an exemplary embodiment of an arrangement with DC voltage regulator according to the invention.

FIG. 3 shows another exemplary embodiment of a DC/DC converter for use in the circuits in accordance with FIG. 1 or 2. The actual DC/DC converter 39 has an input 40 for feeding in an input voltage dropped with respect to reference potential 41. The supply voltage VDD is provided at the output 42. The common signal line 8 is not connected directly to the feedback input 43 of the DC/DC converter. Rather, a low-pass filter, comprising a series resistor 44 and a capacitance 45 connected downstream and connected with respect to reference potential, is provided. Said low-pass filter 44, 45 is connected to the actual feedback input 43 via a coupling resistor 46. Moreover, a voltage divider 49 is provided, comprising a first resistor 47 and a second resistor 48. The first resistor 47 is connected between the output 42 and the feedback input 43. The second resistor 48 is connected between the feedback input 43 and a reference potential terminal. The resistors 47, 48 have resistance values R1, R2. The resistor 44 of the low-pass filter has the resistance value R4. The capacitance 45 of the low-pass filter has the capacitance value C1. The coupling resistor 46 has the resistance value R3.

In order to stabilize the regulating circuit, the low-pass filter comprising the components 44, 45 is used. Said components form the dominant pole in the transfer function of the regulating circuit. The minimum output voltage $VDD_{MIN}$ at the output 42 is set by the ratio of the resistance values R1, R2. The maximum output voltage $VDD_{MAX}$ at the output 42 is set by the values of the resistances R1 to R4. Vref is the voltage at the node 43, which the DC/DC converter keeps constant.

The following stipulations hold true in this case:

$$VDD_{MIN} = Vref\frac{R_1 + R_2}{R_2}$$

$$VDD_{MAX} = Vref\frac{(R_1 + R_2)\|(R_3 + R_4)}{R_2\|(R_3 + R_4)}$$

If accordingly, in the case of the circuit of FIG. 2, for example one of the LED chains 30, 31; 32, 33; 34, 35 breaks to create an open circuit, whereby the feedback voltage UV is forced to reference potential, the supply voltage VDD nevertheless remains within the predetermined limits $VDD_{MIN}$ and $VDD_{MAX}$.

Figure 4:
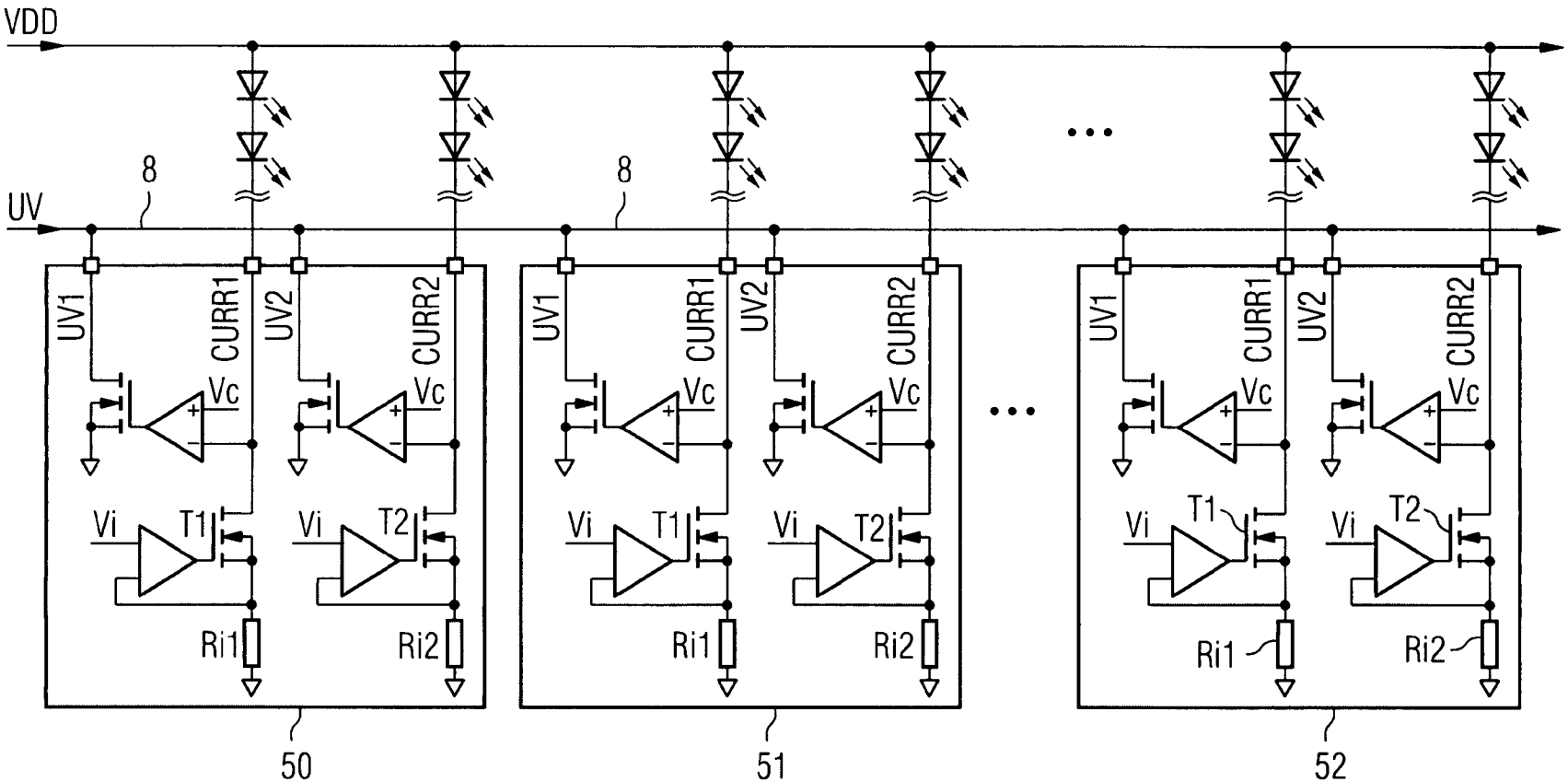
FIG. 4 shows a further exemplary embodiment of a current source arrangement according to the invention.

FIG. 4 shows another development of the circuit of FIG. 2. This largely corresponds thereto in terms of construction and advantageous interconnection and, in this respect, is not described again at this juncture. In the case of FIG. 4, the current branches, comprising respectively a current source, a comparator and a transistor, are formed in each case by way of example in pairs on common monolithically integrated chips 50, 51, 52. In the case of the implementation in accordance with FIG. 4 it becomes clear that despite the embodiment of the individual branches on different chips, a common signal line 8 can nevertheless be provided. No additional circuits are necessary in this case.

Figure 5:
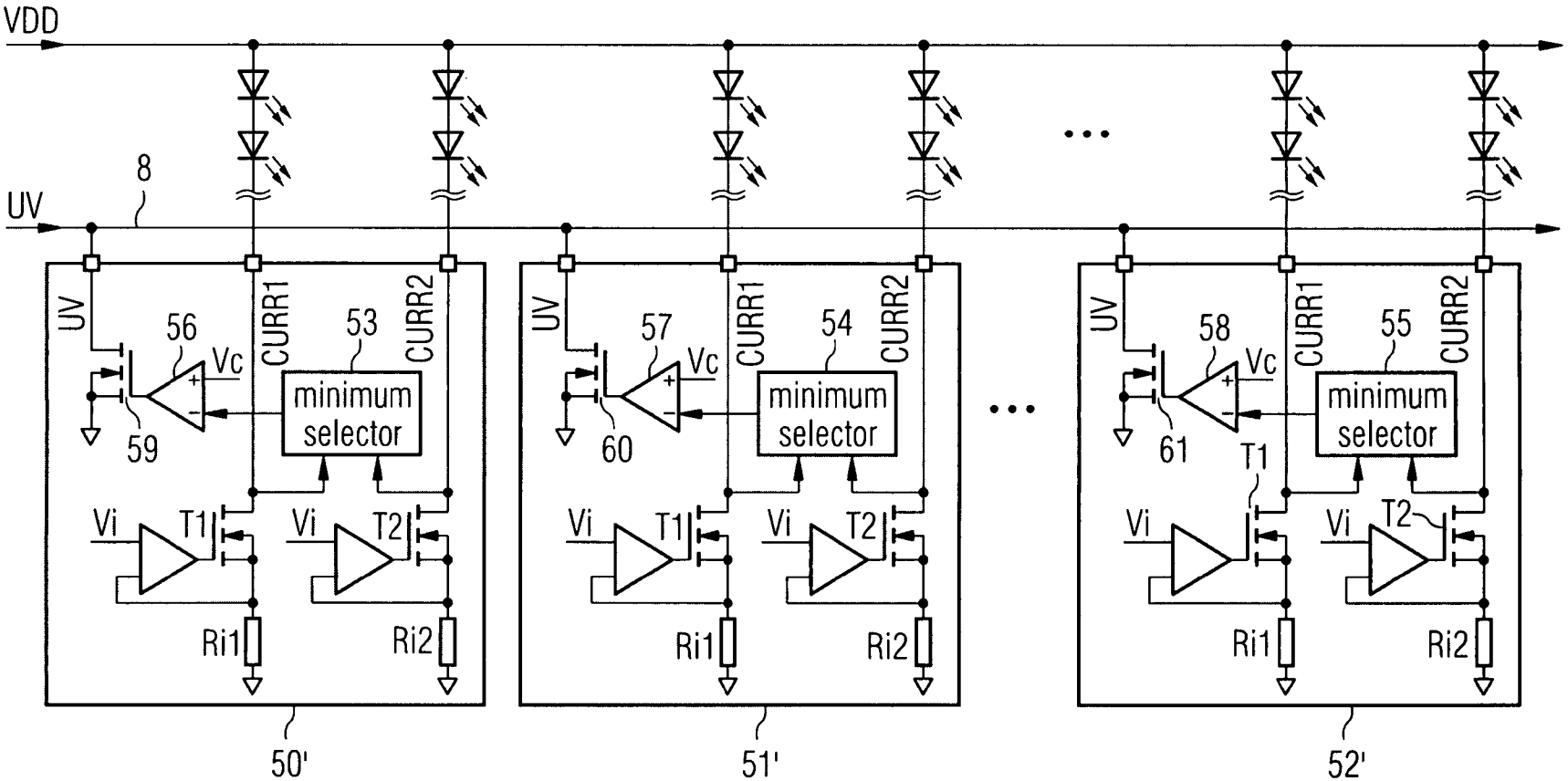
FIG. 5 shows another exemplary embodiment of a current source arrangement according to the invention.

FIG. 5 shows a development of the circuit of FIG. 4, in which the above-disclosed arrangement is combined with the selection of a minimum voltage. For this purpose, a respective minimum selector circuit 53, 54, 55 is provided on each of the chips 50', 51', 52', the inputs of said circuit being connected to the tapping nodes of all the branches on the respective chip. The minimum selector voltage outputs the smallest of the input signals provided thereto. Such circuits are well known and include logic functions such as MIN, MAX, OR, AND, etc. The output of the minimum selector circuit 53, 54, 55 is connected to a common comparator 56, 57, 58 on each chip, the output of which in turn drives a respective common transistor 59, 60, 61 on each chip. A load terminal of said transistor 59, 60, 61 is in turn connected to a signal line 8 common to all the chips 50', 51', 52'. The flexibility can thereby be increased further. Channels based on the selection of a minimum voltage can be combined as desired with the principle proposed.

Figure 6:
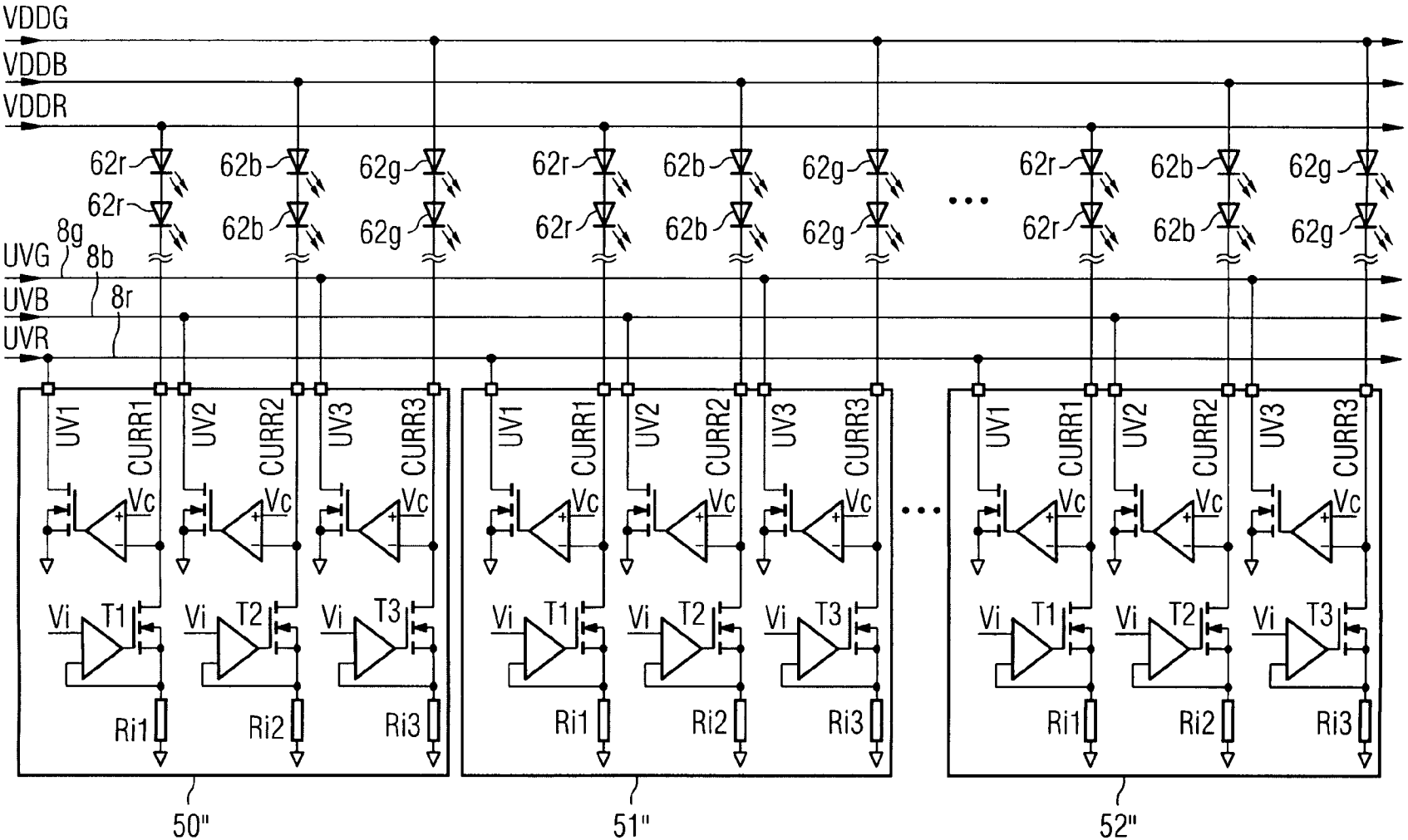
FIG. 6 shows an exemplary embodiment of a current source arrangement according to the invention with different load types.

FIG. 6 shows another development of the circuit of FIG. 4 using an example. The chips 50", 51", 52" in this example each have three branches, comprising respectively a current source, a comparator and a transistor connected thereto. Each of the chips 50' to 52' is designed for driving different types of electrical loads, namely by way of example red diodes 62*r*, blue diodes 62*b* and green diodes 62*g*. In this case, those branches which are designed for driving the red light-emitting diodes 62*r* are connected to a first common signal line 8*r*, while those branches which are designed for driving the blue diodes 62*b* are in each case connected across different chips to a second common signal line 8*b*. Those branches which are designed for driving the green light-emitting diodes 62*g* are connected to a third common signal line 8*g*. The red, blue and green diodes 62*r*, 62*b* and 62*g* are connected on the supply voltage side to a respective assigned supply voltage line, different for each type, for carrying different supply voltages VDDB, VDDR, VDDG.

This serves, as is advantageous for example in RGB applications in the driving of colour displays, to combine different types of electrical loads in groups and to drive them by means of likewise grouped current sources which have a respective common signal line 8*r*, 8*b*, 8*g* per type of electrical load.

Figure 7:
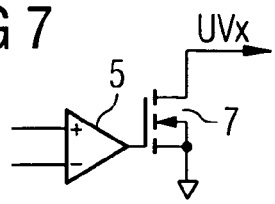
FIG. 7 shows a first exemplary embodiment of a comparator-transistor arrangement.

FIG. 7 shows the embodiment of the comparator 5 with transistor 7 connected downstream in accordance with FIGS. 1, 2 and 4 to 6. Instead of this combination of comparator and transistor, an arrangement according to FIG. 8, 9 or 10 can also be connected in, for example, in FIGS. 1, 2 and 4 to 6.

Figure 8:
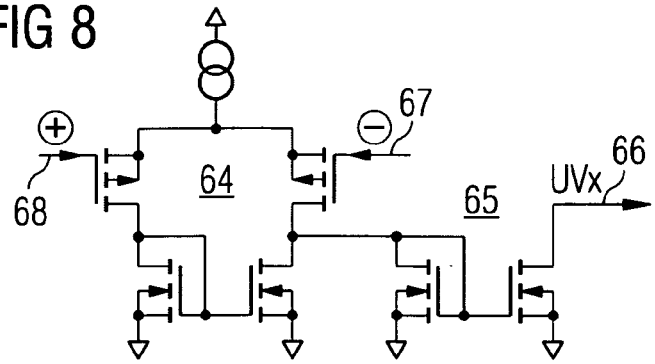
FIG. 8 shows another exemplary embodiment of a comparator-transistor arrangement.

In FIG. 8, the comparator—formed as OTA (operational transconductance amplifier) 64—with current mirror 65 connected downstream, the output transistor of which corresponds to the transistor 7 of FIG. 7, is distinguished in particular by the small chip area requirement. With this circuit, a sink current is output to the output 66, that is to say to the common signal line, only when the voltage at the negative input 67 is less than that at the positive input 68. This is exactly the desired behaviour of the regulating principle.

Figure 9:
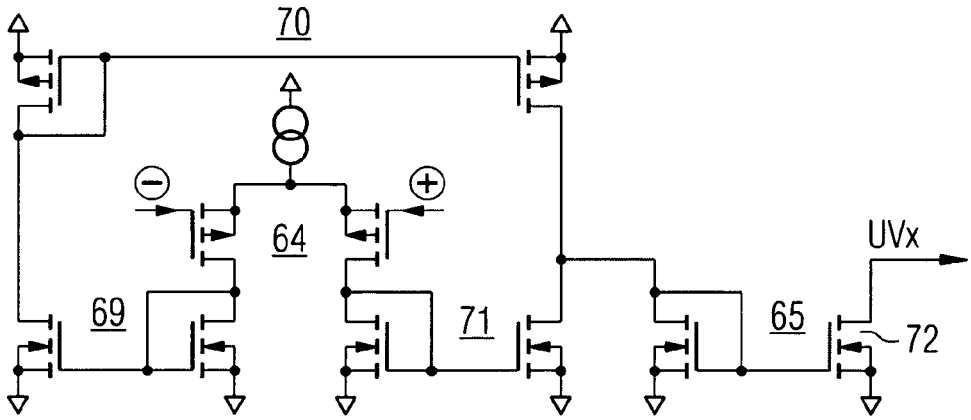
FIG. 9 shows yet another exemplary embodiment of a comparator-transistor arrangement for use in a circuit according to one of FIGS. 1, 2, 4 to 6.

FIG. 9 shows a development of the circuit of FIG. 8, likewise with an OTA 64 and a current mirror 65. For coupling the latter to one another, however, additional current minors 69, 70, 71 are provided, which lead to an improved gain factor and to a better driver capability for the output transistor 72. In order to increase the gain, the input side transistor of current mirror 65, which is connected as a diode, can optionally be removed—as also in the embodiment in accordance with FIG. 8.

Instead of the embodiment of the tapping node 4 between the electrical load 3 and the current source 1, as shown for example in FIGS. 1 and 2, the voltage tapping can also be provided at the control input of the current source transistor 36, instead of at the load terminal of the current source transistor 36.

Figure 10:
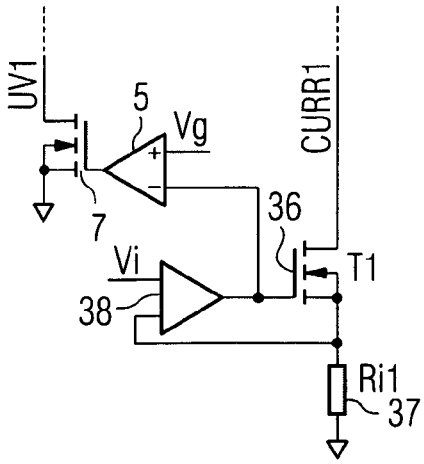
FIG. 10 shows an exemplary embodiment of a voltage tapping node formed at the control input of the current source transistor according to the invention.

The circuit according to FIG. 10 is therefore also an alternative to the embodiment of the current sources according to FIGS. 2 and 4 to 6. The sampling of the voltage at the gate of the current source transistor as tapping node has the advantage that the gate voltage of said transistor is monitored and is within a predetermined limited range, namely limited by the reference voltage Vg at the input of the comparator 5.

This is advantageous in particular with regard to manufacturing variations of the current source transistors. It should be taken into consideration here that the inputs of the comparator 5 must be exchanged. All the circuit arrangements in accordance with FIGS. 7 to 10 can be embodied as shown using field effect transistor technology, e.g. as MOSFETs, or alternatively using bipolar technology.

The principle proposed is advantageous in particular for driving LED arrays, in RGB or single colors. By way of example, the invention can be used in the following areas of application, namely general lighting, backlighting of liquid crystal display, LCD-RGB screens and any desired illumination application in which a plurality of array segments, each comprising series circuits of light-emitting diodes, are used.

The invention claimed is:

1. A current source arrangement, comprising:

a current source;

a connection means for the connection of an electrical load, said connection means being connected to the current source;

a voltage tapping node coupled to the connection means for the connection of the electrical load;

a comparator having a first input, which is connected to the voltage tapping node, and having a second input configured for feeding in a reference threshold voltage;

a transistor connected to an output of the comparator on the control side and to a signal line on the load side; and a DC voltage regulator having an input for feeding in an input voltage, having an output, which is connected to the connection means for the connection of the electrical load, and having a feedback input, which is connected to the signal line.

2. The current source arrangement according to claim 1, comprising:

at least one further current source;

at least one further means for the connection of a further electrical load, said means being connected to the at least one further current source;

at least one further voltage tapping node coupled to the at least one further means for the connection of the further electrical load;

at least one further comparator having a first input, which is connected to the at least one further voltage tapping node, and having a second input set up for feeding in at least one further reference threshold; and at least one further transistor connected to an output of the at least one further comparator on the control side and to the signal line, formed as a common signal line, on the load side.

3. The current source arrangement according to claim 2, wherein the reference threshold and the further reference threshold are identical.

4. The current source arrangement according to claim 2, wherein a means for switching through a smaller one of at least two input voltages is connected between the voltage tapping node and the further voltage tapping node, which are respectively coupled to the current source connected to the means for connection of the electrical load and the further current source connected to the further means for connection of the further electrical load, and the first input of the comparator.

5. The current source arrangement according to claim 1, wherein the electrical load comprises at least one light-emitting diode.

6. The current source arrangement according to claim 1, wherein the electrical load comprises a series circuit of a plurality of light-emitting diodes.

7. The current source arrangement according to claim 1, wherein a respective common signal line is provided for different types of electrical loads.

8. The current source arrangement according to claim 1, wherein the current source comprises a current source transistor.

9. The current source arrangement according to claim 8, wherein the voltage tapping node is coupled to the means for the connection of the electrical load by virtue of the fact that the voltage tapping node being formed at a control terminal of the current source transistor, the controlled path of the current source transistor being formed in a common current path with the means for the connection of the electrical load.

10. The current source arrangement according to claim 8, wherein the current source transistor is connected with its controlled path between the means for the connection of the electrical load and a resistor connected with respect to a reference potential terminal;

a differential amplifier is connected by its output to the control input of the current source transistor;

a first input of the differential amplifier is designed for feeding in a reference voltage; and a second input of the differential amplifier is connected to the reference-potential-side terminal of the controlled path of the current source transistor.

11. The current source arrangement according to claim 1, wherein the comparator comprises an amplifier having a finite gain.

12. The current source arrangement according to claim 11, wherein the comparator comprises a current mirror, the input transistor of which is connected to an output of the amplifier, the transistor of the current source arrangement that is connected to the signal line on the load side being the output transistor of the current mirror.

13. The current source arrangement according to claim 11, wherein the output of the operational amplifier is an asymmetrical output, and in that current mirrors are provided which connect a differential stage of the operational amplifier to the asymmetrical output.

14. The current source arrangement according to claim 1, wherein the electrical load is connected to the means for the connection of the electrical load.

15. The current source arrangement according to claim 1, wherein the current source arrangement is monolithically integrated using semiconductor circuit technology.

16. A currently supply of light-emitting diodes arranged in matrix form in a display device comprising one or more current source arrangements according to claim 1.

17. A current supply of light-emitting diodes of respective color type in a display device comprising at least one current source arrangement according to claim 1.

18. A method for operating an electrical load, comprising the steps of:

providing a supply current for the electrical load by means of a current source;

tapping of a voltage dropped across the electrical load and/or the current source or a voltage derived therefrom;

comparing the voltage thus determined with a reference threshold;

driving a signal line by means of a transistor in a manner dependent on the comparison; and providing a supply voltage for the electrical load in a manner dependent on an input voltage and a signal on the signal line.

19. The method according to claim 18, comprising the steps of providing a further supply current for a further electrical load by means of a further current source;

tapping off a voltage dropped across the further electrical load and/or the further current source or a voltage derived therefrom;

comparing the voltage thus determined with a further reference threshold;

driving the signal line, embodied as a common signal line, by means of a further transistor in a manner dependent on the comparison; and providing the supply voltage for the electrical load and the further electrical load in a manner dependent on the input voltage and the signal on the common signal line.

* * * * *